US005311835A

United States Patent [19]

Knowles

[11] Patent Number: 5,311,835

[45] Date of Patent: May 17, 1994

[54] BOOKMARK FOR IDENTIFYING A LOCATION ON A PAGE

[76] Inventor: Horace A. Knowles, 506 G Street, SW., Washington, D.C. 20024

[21] Appl. No.: 131,518

[22] Filed: Oct. 4, 1993

[51] Int. Cl.[5] ..... B42D 9/00

[52] U.S. Cl. ..... 116/235; 116/234

[58] Field of Search ..... 116/234, 235, 236, 237, 116/238, 239, 240; 281/42

[56] References Cited

U.S. PATENT DOCUMENTS 1,420,265 6/1922 Kieckhefer ..... 116/235
1,966,340 7/1934 Forbringer et al. ..... 116/235
4,901,665 2/1990 Carlin ..... 116/235

FOREIGN PATENT DOCUMENTS 0667623 10/1988 Switzerland ..... 116/234
2222387 3/1990 United Kingdom ..... 116/234

*Primary Examiner*—William A. Cuchlinski, Jr.
*Assistant Examiner*—W. Morris Worth

[57] ABSTRACT

A bookmark for identifying a single page and a location on that page by its position in the book with respect to indicia for odd-numbered pages and even-numbered pages and indicia for page locations printed on the bookmark.

6 Claims, 4 Drawing Sheets

BOOKMARK FOR IDENTIFYING A LOCATION ON A PAGE

BACKGROUND OF THE INVENTION

Conventional bookmarks can mark or identify two pages of a text. They do not provide any information to identify a particular page or a location on that page. A user who intends to mark where to begin reading must rely on recollection. If the user's memory fails, it is necessary to reread some or all of the two pages which are marked. This is burdensome, particularly in the setting of a lecture or sermon. A common means for marking a place on a page is to use a highlighter or other marking device. Such markings diminish the integrity of the book and often cannot be made as in the case of manuscripts, library books, heirlooms, Bibles, etc.

SUMMARY OF THE INVENTION

It is an object of the present invention to provide a bookmark which will identify a single page and a location on that page without any marking by its position within the book. This object is achieved by the bookmark provided by the present invention, which comprises a substrate of a thickness suitable for insertion between pages, said substrate having indicia printed thereon for odd-numbered pages and even-numbered pages, said substrate also having indicia printed on each side thereof representing the location on the page such as the top, one-quarter, one-half, and three-quarter portions of a page, said indicia being configured so that the side facing the front of the book identifies the page number as odd or even and the length of the bookmark protruding from the top of the book identifies the location on a page.

In another embodiment, indicia for odd-numbered pages is printed on one end of the bookmark, indicia for even-numbered pages is printed on the opposite end of said bookmark, and indicia representing the top, one-quarter, one-half, and three-quarter portions of a page is printed on both ends of the bookmark.

In a preferred embodiment, the indicia for odd-numbered pages is "odd", and the indicia for even-numbered pages is "even". The indicia f or the top, one-quarter, one-half, and three-quarter positions on a page preferably comprises four lines, most preferably multicolored lines labelled "Top", "$\frac{1}{4}$", "$\frac{1}{2}$", and "$\frac{3}{4}$", respectively.

A kit comprising a bookmark and printed instructions f or use are also provided, a preferred embodiment being bookmarks with the instructions printed thereon. A method of using the bookmark is also provided.

DETAILED DESCRIPTION OF THE PREFERRED EMBODIMENTS

The bookmark comprises a substrate of a thickness suitable for insertion between pages. The substrate preferably is sufficiently thin so as not to stretch the binding of the book. A suitable thickness can be from 1–10 times the thickness of a page. The substrate can comprise any material which will maintain a planar shape such as paper, cardboard, or natural or synthetic resins. Preferably, the substrate provides a printable surface.

Figure 1:
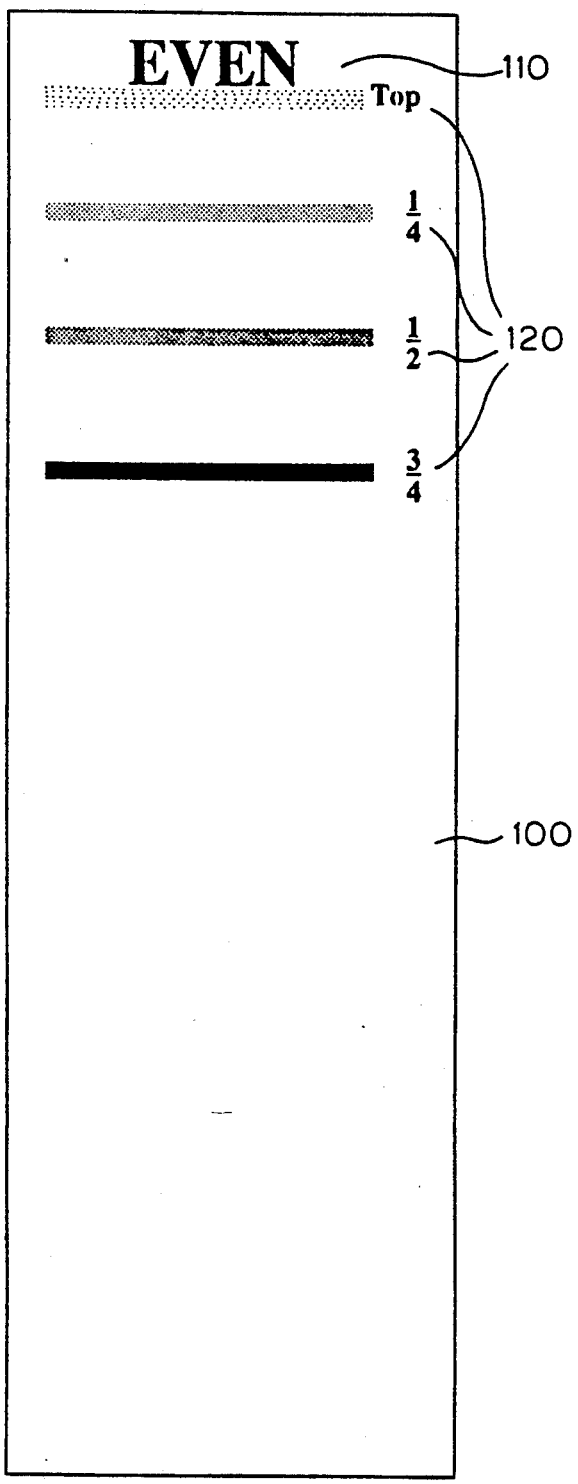
FIG. 1 represents an embodiment of the present invention having indicia on both sides.
Figure 2:
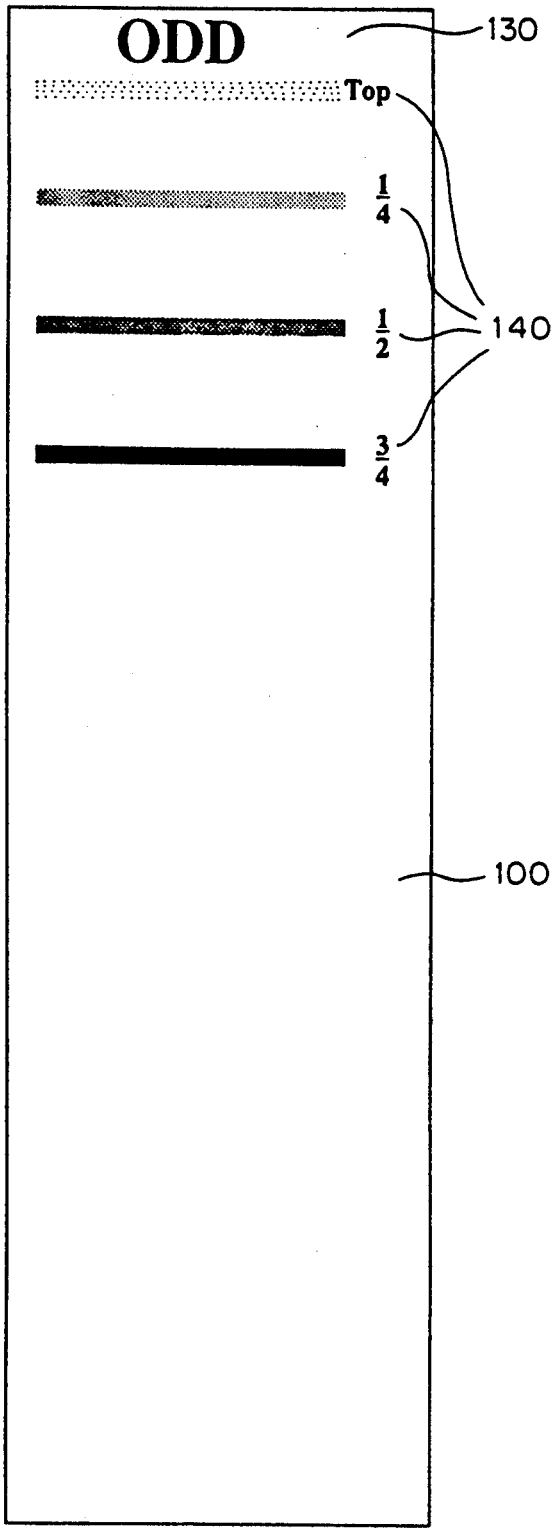
FIG. 2 illustrates the opposite side of the embodiment shown in FIG. 1.
Figure 3:
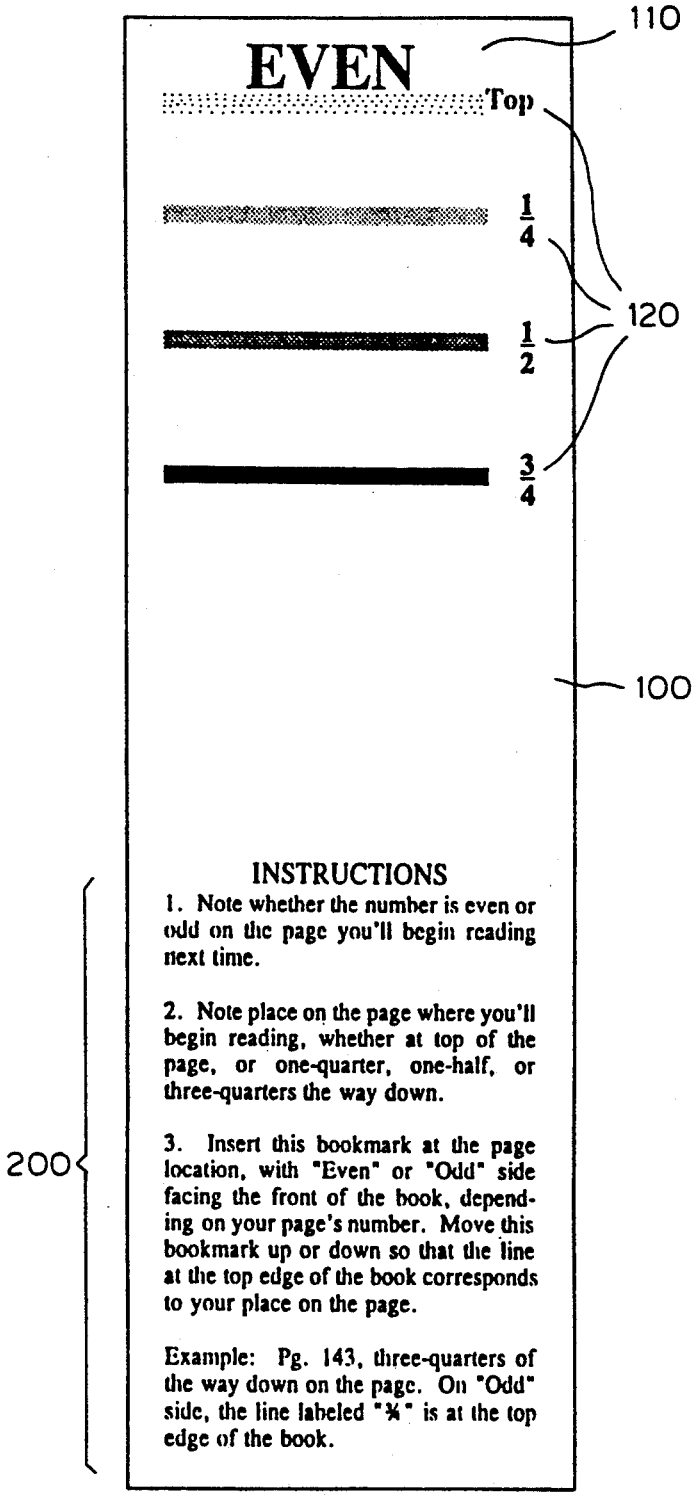
FIG. 3 represents another embodiment of the present invention which includes instructions for use.
Figure 4:
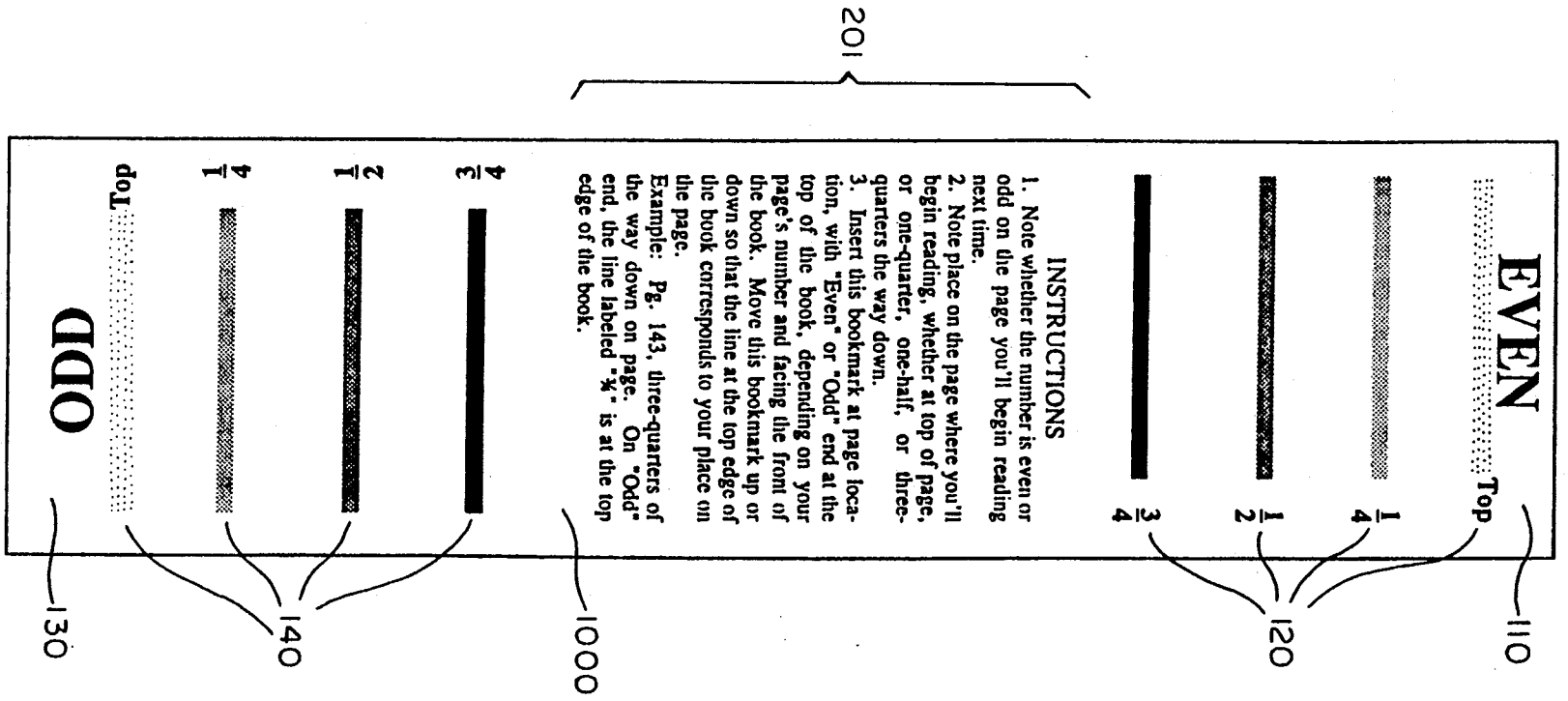
FIG. 4 represents an additional embodiment of the present invention with indicia on only one side and which includes instructions for use.

Referring to FIG. 1, a bookmark 100 is shown with the indicia 110 "even" printed thereon for even-numbered pages. Also shown are the indicia 120 for locations on an even-numbered page which comprise four lines labelled "Top", "$\frac{1}{4}$", "$\frac{1}{2}$", and "$\frac{3}{4}$", respectively. FIG. 2 represents the opposite side of the bookmark 100, with the indicia 130 for odd-numbered pages and the indicia 140 for locations on a page. FIG. 3 illustrates a preferred embodiment, wherein indicia 200 provide instructions for use of the bookmark 100. FIG. 4 represents an alternative embodiment, wherein indicia 130 for the odd-numbered pages and indicia 110 for even-numbered pages appear on the same side of the bookmark 1000 at opposite ends, as do indicia 140 and 120 for the location on a page. Instructions are included in this preferred embodiment as indicia 201, which are slightly different from the embodiment of FIG. 3.

The kit provided by the present invention comprises a bookmark as described above, together with printed instructions on use. The printed instructions appear on a wrapper or a separate card. In preferred embodiments, these instructions are printed on the bookmark itself, as shown in FIGS. 3 and 4. An example of printed instructions which form part of a kit containing the bookmark 100 reads as follows:

1. Note whether the number is even or odd on the page you'll begin reading next time.
2. Note place on the page where you'll being reading, whether at top of the page, or one-quarter, one-half, or three-quarters the way down.
3. Insert the bookmark at the page location, with "Even" or "Odd" side facing the front of the book, depending on your page's number. Move the bookmark up or down so that the line at the top edge of the book corresponds to your place on the page.

Example: Pg. 143, three-quarters the way down on the page. On "Odd" side, the line labelled "$\frac{3}{4}$" is at the top edge of the book.

The instructions identify how the bookmark is to be positioned so as to designate odd- or even-numbered pages and the location on the page.

Where the lines are multicolored, the bookmark may be positioned so that the color whose location corresponds to the place on the page shows at the top edge of the book. The instructions may vary significantly, depending on the indicia used and its location on the bookmark. For example, the instructions for the bookmark 1000 of FIG. 4 are different from those of bookmark 100 of FIG. 3:

1. Note whether the number is even or odd on the page you'll begin reading next time.
2. Note place on page where you'll begin reading, whether at top of page, or one-quarter, one-half, or three-quarters the way down.
3. Insert this bookmark at page location, with "Even" or "Odd" end at the top of the book, depending on your page's number, and facing the front of the book.

Move this bookmark up or down so that the line at the top edge of book corresponds to your place on the page. Example: Pg. 143, three-quarters way down on page. On "Odd" end, the line labelled "¾" is at the top edge of the book.

The indicia used to identify the odd- and even-numbered pages can vary significantly. The words "even" and "odd" are used in the embodiments shown; however, other words, colors, numbers, or pictures can be used to identify odd- and even-numbered pages. The indicia used to identify page location can also vary significantly. Four labelled lines are used in the embodiment of FIGS. 1–4. However, additional lines may be used. In addition, different labels or no labels may be used, or other markings can be used in place of lines as long as the extent to which the bookmark protrudes from the book identifies the page location.

The methods provided by this invention comprise the instructions for using the bookmark, as set forth above.

I claim:

1. A bookmark for identifying a single page of a book and a location on said page, consisting of a substrate of a thickness suitable for insertion between pages of said book, said substrate having indicia printed near a top edge of one side for indicating odd-numbered pages and indicia printed near a top edge of an opposite side of indicating even-numbered pages, each side of said substrate also having indicia for indicating locations on the page identified, wherein said indicia are configured so that the side exposed to the front of a closed book identifies the page as odd or even, and location indicating indicia positioned closest to an edge of the closed book identifies the location on the page.

2. A book mark for identifying a single page of a book and location on said page, consisting of a substrate of a thickness suitable for insertion between pages of said book, said substrate having indicia printed near a top edge of one end for indicating odd-numbered pages and indicia printed near a top edge of an opposite end for indicating even-numbered pages, said substrate also having indicia printed one each end beneath said indicia at a top edge for indicating locations on the page identified, wherein said indicia are configured sot at an end of the substrate which extends from a top of the book identifies the page as odd or even, and exposing a selected one of said indicia for indicating locations identifies the location on the page.

3. A bookmark for identifying a single page of a book and a location on said page, consisting of a substrate of at thickness suitable for insertion between pages of said book, indicia "EVEN" printed near a top edge of one side of said bookmark, indicia "ODD" printed near a top edge of an opposite side of said bookmark, and four spaced part, parallel lines extending across the bookmark on each side beneath the indicia at a top edge labelled "Top", "¼", "½", and "¾", respectively.

4. A bookmark for identifying a single page of book and a location on said page, consisting of a substrate of a thickness suitable for insertion between pages of said book, indicia "EVEN" printed on one side of the bookmark near one end of said bookmark, indicia "ODD" printed on the same side near an opposite end of said bookmark and four spaced apart, parallel lines extending across the bookmark at each end beneath the indicia, each line being labelled "Top", "¼", "½", and "¾", respectively.

5. A method for using the bookmark of claim 3, which comprises:

(a) noting whether the number is even or odd on the page to be read next time;

(b) noting a place on the page to begin reading, whether at top of the page, or one-quarter, one-half, or three-quarters the way down;

(c) inserting the bookmark at the page location, with "Even" or "Odd" side facing front of the book, depending on the page number noted in step (a); and (d) moving the bookmark up or down so that the line appearing closest to a top edge of the book corresponds to the place on the page noted in step (b).

6. A method for using the bookmark of claim 4, which comprises:

(a) noting whether the number is even or odd on the page to be read next time;

(b) noting a place on the page to begin reading, whether at top of the page, or one-quarter, one-half, or three-quarters the way down;

(c) inserting the bookmark at the page location, with "Even" or "Odd" end at the top edge of the book, depending on the page number noted in step (a) and facing the front of the book; and (d) moving the bookmark up or down so that the line appearing closest to the top edge of the book corresponds to the place on the page noted in step b.

* * * * *